United States Patent [19]

Nii et al.

[11] 4,433,432

[45] Feb. 21, 1984

[54] X-RAY TUBE APPARATUS

[75] Inventors: Katsutoshi Nii; Kinpei Okano; Motomichi Doi, all of Hitachi; Minoru Kitsuya, Mobara, all of Japan

[73] Assignee: Hitachi, Ltd., Tokyo, Japan

[21] Appl. No.: 318,016

[22] Filed: Nov. 4, 1981

[30] Foreign Application Priority Data

Nov. 4, 1980 [JP] · Japan ..... 55-153911

[51] Int. Cl.[3] ..... H01J 35/16

[52] U.S. Cl. ..... 378/193; 378/202

[58] Field of Search ..... 378/202, 200, 132, 193

[56] References Cited

U.S. PATENT DOCUMENTS 2,121,630 6/1938 Gross ..... 378/202

2,216,887 10/1940 Machlett ..... 378/200

*Primary Examiner*—Craig E. Church

*Attorney, Agent, or Firm*—Thomas E. Beall, Jr.

[57] ABSTRACT

A rotary anode X-ray tube accommodated in a housing together with oil has a journal box fixed and inwardly extending inside the tube, an anode target fixed to a rotor supported by the journal box and a cathode member opposing the anode target and fixed at an end portion inside the tube opposing the journal box. The fixing portion between the rotary anode X-ray tube and the journal box is supported by a resilient support member on the housing and vibration damping means is disposed on the support member. The vibration damping means includes a moving member fixed at its center and a fixed member fixed to the housing so as to encompass the moving member with a predetermined gap, and oil is fully charged in the gap. Vibration of the rotation system is transmitted to the moving member and the operation of this member damps the vibration by means of the squeeze action of the oil.

19 Claims, 5 Drawing Figures

X-RAY TUBE APPARATUS

BACKGROUND OF THE INVENTION

This invention relates to an improvement to an X-ray tube apparatus, and more specifically to oscillation or vibration absorbing means for the X-ray tube apparatus.

X-ray tube apparatuses generally include a housing in which insulating oil is sealed, a rotary anode X-ray tube (hereinafter referred to as the "X-ray tube") placed in the housing and supported by a support and a stator fixed to the housing and forming a motor in cooperation with a rotor placed in the X-ray tube. The X-ray tube consists of a glass bulb maintaining a vacuum inside, with a sleeve-like journal box fixed at one of the ends of the bulb so as to extend inwardly in the axial direction. The journal box supports, via ball bearings, the rotor to which an anode target is fixed. The rotor is positioned so as to oppose the stator via the wall of the glass bulb. A cathode is fixed at the other end of the glass bulb. A part of the cathode opposes the anode target and projects the electron beam to the anode target so that the X-rays are emitted from the surface of the anode target.

When the electron beam is radiated to the anode target, it attains an average temperature of about 1,200° C. Since the inside of the glass bulb is in high vacuum, most of the heat is radiated and transferred to the outside. However, a part of the heat of the anode target is transmitted to the shaft, to the ball bearings, and then to the journal box, and the temperature of the journal box reaches about 500° C. In view of thermal expansion, therefore, ball bearings having a bearing gap ranging from 30 μm to 60 μm (compared to 5 to 10 μm in ordinary motors in general) are generally employed. In the room temperature environment at the initial stage of rotation, the gap between the ball bearings is so great that the anode target causes unstable rotation oscillation as well as large rotation noise. Especially in a critical speed range in which rotating oscillation rapidly increases, an abnormal load acts upon the ball bearings and the latter are frequently damaged prematurely.

As methods of reducing the dynamic load acting upon the ball bearings, Japanese Patent Publication No. 12162/1970, Japanese Patent Laid-Open No. 57786/1974 and Japanese Patent Laid-Open No. 44691/1974 propose a construction which sets the critical speed to a lower level by reducing the support rigidity of the rotation system. These proposals are effective for reducing the critical speed of the rotation system and mitigating the dynamic load due to the mass unbalance that acts upon the ball bearings. When the full speed range is taken into account, however, they are not yet sufficient to prevent damage to the ball bearings. This can be confirmed from the fact that when the rotating oscillation characteristics of the X-ray tube are actually measured, rotating oscillation rapidly increases in a high speed range after passing through the critical speed range and exhibits unstable oscillation characteristics even in a flexible support structure.

According to an oscillation-proofing design for high speed rotary machines in general, an oscillation damping element or elements are disposed in the proximity of bearings so as to absorb abnormal or unstable oscillation. However, since the X-ray tube is placed in the specific environment of high vacuum and high temperature, ordinary damping means using oil film dampers or oscillation-proof rubbers can not be used in the X-ray tube. Though a solid friction damper can be used, the friction surface is likely to catch due to the high temperature and high vacuum condition, and the damper soon loses its function.

Oscillation-proofing of the anode target is necessary for extending the life of the ball bearings and for reducing the noise of the rotation sound. Especially when oscillation of the anode target becomes great, focusing of the X-rays is likely to deviate and satisfactory picture quality can not be obtained. If the apparatus is of a micro-small focusing type, excessive oscillation results in a critical problem in X-ray photography.

SUMMARY OF THE INVENTION

It is an object of the present invention to provide an X-ray tube apparatus which eliminates all the above-mentioned problems, reduces vibration and noise of the anode target from room temperature to high temperature over the entire rotation range, permits only limited dynamic load to act upon the bearings and thus has extended service life.

The present invention is characterized in that the end portion of the rotary anode X-ray tube is resiliently supported and is equipped wih vibration damping means.

The vibration damping means for the rotation system in accordance with the present invention are disposed outside the anode X-ray tube so that sufficient vibration-damping effects can be obtained without making the construction of the rotary anode X-ray tube itself complicated.

DESCRIPTION OF THE PREFERRED EMBODIMENTS

An embodiment of the X-ray tube apparatus in accordance with the present invention will be described in detail with reference to the accompanying drawings.

Figure 1:
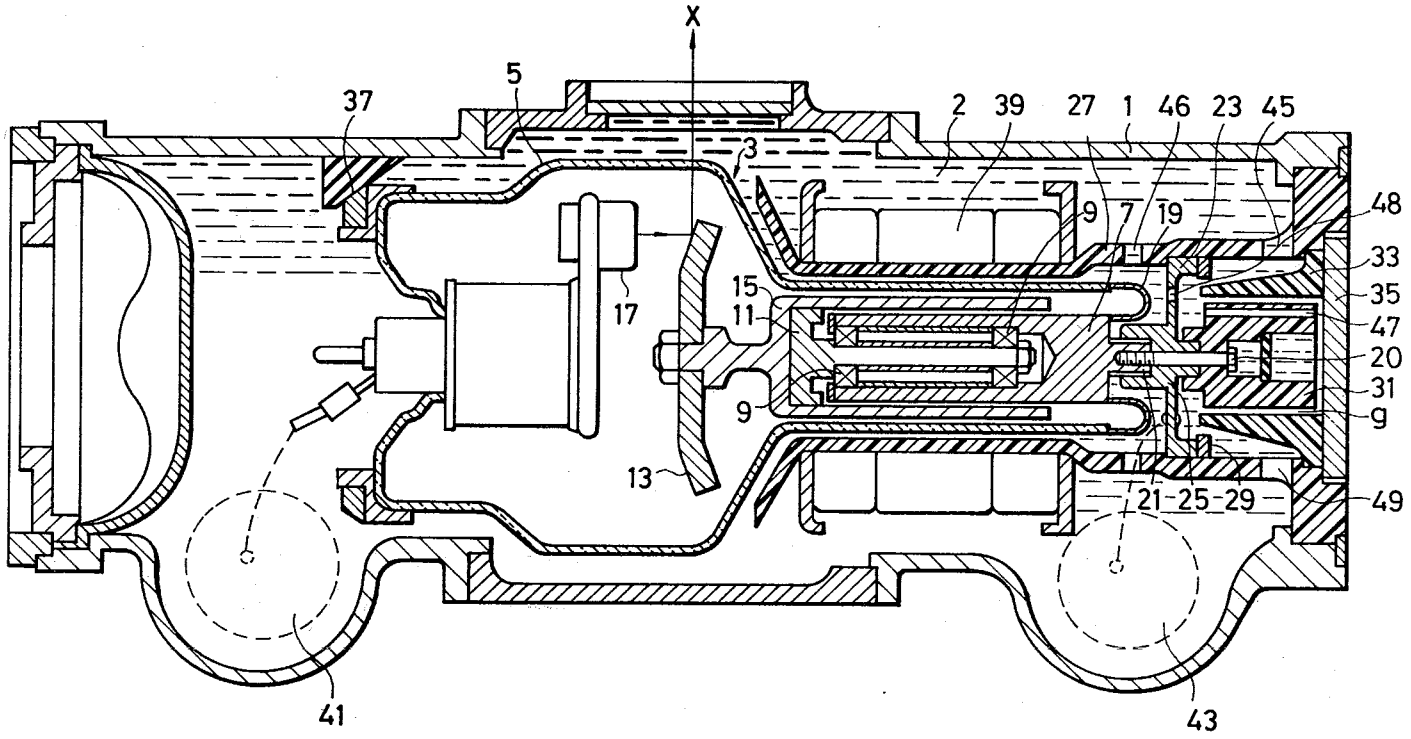
FIG. 1 is a sectional front view of the X-ray tube apparatus in accordance with an embodiment of the present invention.

In FIG. 1, the X-ray tube apparatus includes a housing 1 and a rotary anode X-ray tube 3 (hereinafter referred to as the "X-ray tube") that is accommodated in the housing together with insulating oil 2. The X-ray tube 3 includes a glass bulb 5 for holding the vacuum, a sleeve-like journal box 7 disposed at one end of the glass bulb and extending inwardly in the axial direction, a shaft 11 supported by ball bearings 9 fixed around the inner circumference of the journal box 7, a rotor 15 fixed to one of the ends of the shaft and having one of its ends extending so as to cover the outer circumference of the journal box 7 and the other having an anode target 13 fixed to it, and a cathode 17 free inside the housing so as to oppose the fixed end portion of the journal box 7. A part of this cathode 17 opposes the anode target 13 with a gap between them and radiates the electron beam to the anode target 13 so that the target emits the X-rays.

The fixed end portion of the journal box 7 is hermetically fixed to the end portion of the glass bulb 5 via a thin metal plate 19 (e.g. thin cover plate having a substantially equal thermal expansion coefficient to that of the glass bulb), and a part of the journal box 7 is exposed to the outside. A screw is formed at the end of this exposed portion.

At one of its ends, the X-ray tube 3 is fixed to the housing 1 by a support 23. This support 23 is made from metal shaped in a disc with bosses formed on both sides of its center 25 and a flange formed around its outer edge portion, each being a rigid body. The portion of the disc between the outer edge portion and the center has a reduced thickness in order to reduce the rigidity to a suitable level and to make it flexible. A screw thread is formed in the inner boss of the support 23 so as to firmly mate with the screw thread of the journal box 7.

The outer edge portion of the disc forms a part of the housing 1 and is inserted into a frame 27, that extends inwardly in the axial direction of the housing, and is firmly fixed by a retaining ring 29. Thus, the X-ray tube is resiliently supported at one of its ends to the housing 1. A cylindrical moving member 31 is fixed by a set screw 20 in a cantilevered arrangement on the opposite side of the support 23 relative to the journal box 7. A ring 33 is fixed to the housing 1 in such a fashion that its inner circumferential surface opposes the outer circumferential surface of the moving member 31 with a gap g between them. A flange is formed at one of ends of the ring 33 and forms a part of the housing 1. The flange is pressed between the frame 27 and a disc-like lid 35 having a screw portion at its outer circumference. The insulating oil 2 is fully charged into this cylindrical gap g. The moving member 31, the ring 33 and the insulating oil 2 together form a vibration damping means by the fluidization of the oil inside the gap g.

The other end of the X-ray tube is resiliently supported by a plurality (preferably three) of resilient pads 37 (e.g. rubber pads or pads of other suitable materials) equidistantly disposed around the inner circumference of the housing 1.

A stator 39 for generating a magnetic field is disposed on the aforementioned frame 27. The stator 39 opposes the rotor 15 through the tube wall of the glass bulb 5 and forms a motor with the rotor. Reference numerals 41 and 43 represent lead wire connectors and reference numerals 45 to 49 represent communication ports for the insulating oil 2.

When the stator 39 generates a magnetic field, the rotor 15 and the anode target 13 fixed to the former rotate at a predetermined high speed, e.g., 3000–9000 rpm. The electron beam is generated from the cathode 17 by applying a high voltage between the cathode 17 and the anode target 13, and is radiated to the anode target 13. The X-rays are emitted from the surface of the anode target 13 in the direction represented by X in the drawing. While the X-rays are generated, a high voltage is impressed. Hence, to insure electric insulation of the apparatus as a whole, the insulating oil 2 is admitted in the housing 1. During the generation of the X-rays, the temperature of the anode target 13 reaches about 1,200° C., and heats the ball bearings to about 500° C. The gap between the ball bearings is therefore greater (e.g. 30–60 μm) than that of an ordinary motor. This gap would result in vibration, but the vibration is absorbed by the vibration damping means.

This vibration damping means is an oil film damper making use of the squeeze action of an oil film. As shown in the drawing, since the oil is fully charged in the housing 1, a pressure is generated in the cylindrical gap defined between the moving member 31 and the ring 33 when the moving member 31 vibrates and the oil inside the gap g moves in the axial direction and in the circumferential direction so that the vibration energy is absorbed in the gap g. The vibration-absorbing operation of this oil film damper increases in proportion to the vibration speed of the moving member 31, so the vibration transmitted from the rotation system to the journal box 7 is absorbed by the damping means using this oil film damper, via the support 23. Since the position at which the moving member 31 performs the oil film damping action is away from the support 23, the vibration amplitude is high and so the vibration-damping effect is great.

The rigidity of the support 23 is reduced in order to permit the damping means to operate effectively. The lower the rigidity of the support 23, the easier it becomes for the moving member 31 to displace and the higher the function of the oil film damper. A preferred range is up to 1 kg/mm from the relation between the displacement of the shaft core portion of the anode target 13 and the load, and up to 20 kg/mm in terms of the spring constant, with the proviso that no plastic deformation occurs. The size of the cylindrical gap g is preferably from 0.3 to 0.6 mm. If the gap is below 0.3 mm, assembly is not easy and the moving member 31 would contact the ring 33 due to vibration. If the gap exceeds 0.6 mm, on the other hand, the vibration damping effect would be lowered. Higher viscosity oil may make use of the gap more than 0.6 mm.

The low rigidity support is coupled to housing 1 via the frame 27. Consequently, vibration from outside is also absorbed by the damping means and no vibration from outside is transmitted to the rotation system, thereby stabilizing the focus of the X-rays. Since the journal box 7 is supported by the support 23 with a suitable level of rigidity, the dynamic load on the ball bearings 9 is reduced.

Vibration of the anode target 13 in the radial direction was actually measured for an apparatus equipped with the damping means and one not equipped with the same, in order to confirm the effect of the construction of the present invention.

Figure 5:
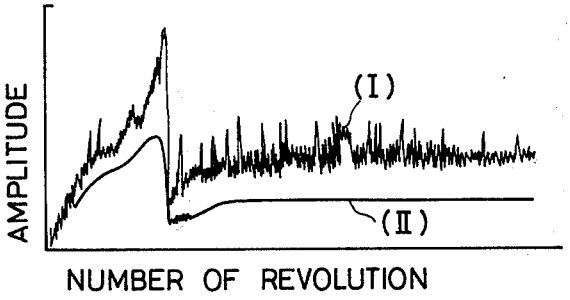
FIG. 5 is a graph comparing the rotation vibration or oscillation between the X-ray tube apparatus in accordance with the present invention and that of the prior art apparatus.

FIG. 5 illustrates comparatively the results of the actual measurement of the rotating vibration of the anode target 13. Since the vibration was measured from the stationary side, the diagram shows the resultant vibration of the anode target 13 and the journal box 7. As can be seen from the diagram, the conventional construction (I) not using the damping means exhibited unstable vibration from low to high speed ranges, and not only the rotation noise was great but also irregular sound was generated. Especially in the critical speed range where the vibration amplitude rapidly increases, the rotation noise was great. In the construction (II) equipped with the damping means of the present invention, the amplitude was small when passing through the critical speed range and the apparatus exhibited stable vibration characteristics up to the high speed range. Further, the rotation noise was low and did not change even in the critical speed range. Hence, the apparatus could be operated with low noise. It was also found that in the construction of the present invention, vibration of the rotation system and that of the journal box were effectively absorbed.

Figure 2:
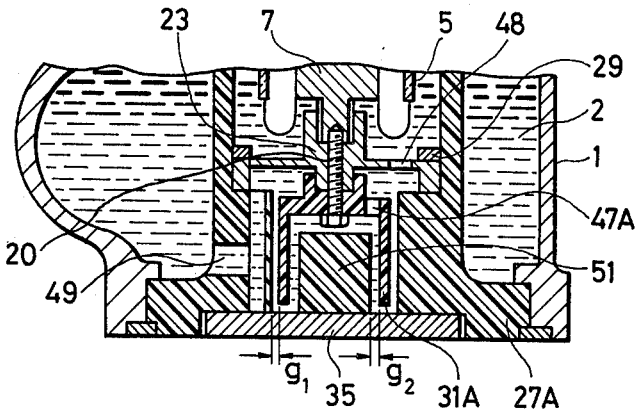
FIGS. 2 through 4 are partial sectional views of the X-ray tube apparatus in accordance with other embodiments of the present invention.

FIG. 2 shows another embodiment of the present invention. An inner cylinder 51 is disposed inside the moving member 31A and is fixed to a lid 35 which is a part of the housing 1. Cylindrical gaps $g_1$ and $g_2$ are defined around the inner and outer circumferences of the moving member 31A so that they exhibit the damping action. Though the gap g around the outer circumference of the moving member 31 in FIG. 1 is formed by the ring 33, the gap $g_1$ around the outer circumference of the moving member 31A in the embodiment shown in FIG. 2 is formed between it and the inner circumference of a part of the frame 27A, in order to reduce the number of components. Either construction also damps the vibration in the radial direction.

Figure 3:
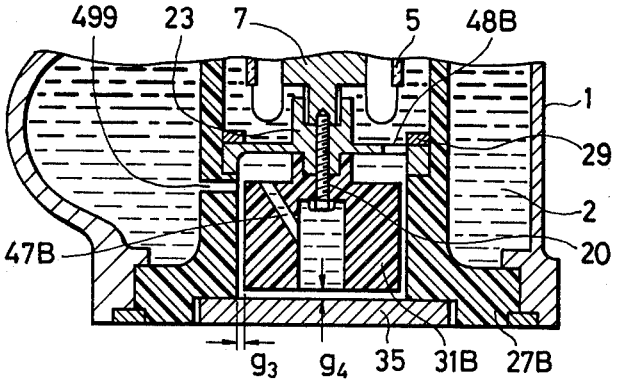

FIG. 3 shows still another embodiment of the vibration damping means. A part of the frame 27B which has the stator formed on it is shaped in a cylinder, and a cylindrical moving member 31B is inserted into this cylinder with a gap $g_3$. One end of this moving member 31B is fixed to the support 23 and the edge surface of the other end faces the inner surface of the lid 35 of the housing 1 with a gap $g_4$ between them. The insulating oil 2 is charged fully into these gaps $g_3$ and $g_4$ through the communication ports 47B, 48B and 49B. The construction of the apparatus other than the damping means is the same as that of FIG. 1. In this embodiment, the vibration damping effect is effectively brought forth by the two gap portions. Especially because the gap $g_4$ is far away from the support 23, the distance the moving member 31B vibrates is great at this portion, and damping can be effectively realized.

Figure 4:
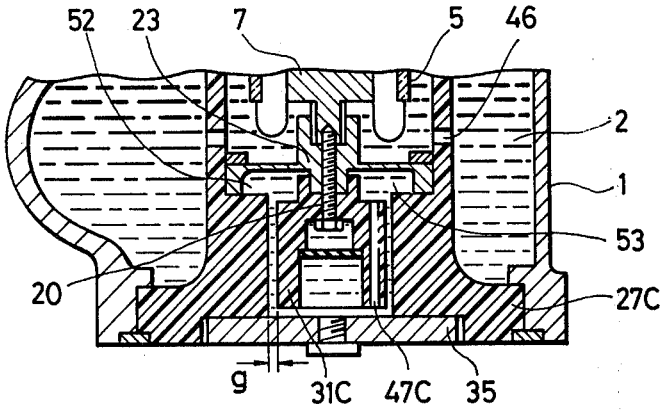

FIG. 4 shows a construction in which a space portion 53 defined by the support 23 and the frame **27*c* is used as a sealed chamber and oil 52** of high viscosity is sealed in this sealed chamber in order to accomplish effective absorption of vibration.

Though the foregoing embodiments make use of the squeeze action of the oil film for the damping means, substantially the same effect can of course by obtained by damping means using viscous friction and solid friction or using internal damping of materials such as rubber. Further, while the thickness at a part of the support 23 was reduced in order to obtain suitable rigidity, the same effect can be obtained by forming slits between the center and the outer edge portions.

In accordance with the present invention, rigidity of the support is reduced and the support is equipped with damping means. According to this arrangement, vibration of the rotary anode X-ray tube as a whole can be effectively absorbed, and hence the dynamic load acting upon the ball bearings can be reduced. It becomes thus possible to use the apparatus with stable rotary characteristics for an extended period and to obtain quality X-ray photographs.

What is claimed is:

1. An X-ray tube apparatus comprising:

a housing forming an accommodation chamber;

a rotary anode X-ray tube disposed inside said housing and including electron beam generation means, rotor means having an anode target for generating X-rays, and bearing support means for supporting bearings which support said rotor means;

support means for resiliently supporting said rotary anode X-ray tube to said housing, fixed to said bearing support means; and vibration damping means disposed outside said rotary anode X-ray tube and engaging with at least one of said bearing support means and said support means.

2. The X-ray tube apparatus as defined in claim 1 wherein said support means is a disc-like elastic member, the center and peripheral portions of which are formed as a rigid body and the center of which is fixed to said bearing support means.

3. The X-ray tube apparatus as defined in claim 2 wherein said vibration damping means includes a moving member fixed to the center of said support means, a fixed member fixed to said housing and disposed so as to oppose said moving member with a predetermined gap between them, and a viscous liquid filling said gap.

4. An X-ray tube apparatus comprising:

a housing having oil admitted therein;

a rotary anode X-ray tube accommodated inside said housing;

said rotary anode X-ray tube including a vacuum tube for holding the inside thereof in vacuum;

said vacuum tube incorporating therein a cathode member, a rotor having an anode target fixed thereto and a bearing device rotatably supporting said rotor, extending inwardly in the axial direction and having one of its ends fixed to said vacuum tube and forming a part of the tube wall of said vacuum tube;

a stator fixed to said housing, having the inner surface thereof facing said rotor through the tube wall of said vacuum tube and forming a motor in cooperation with said rotor;

a support member fixed to the fixed end portion of said bearing device and resiliently supporting said bearing device relative to said housing; and vibration damping means disposed on said support member so as to oppose said bearing device.

5. The X-ray tube apparatus as defined in claim 4 wherein said support member has its center and peripheral portions formed in a rigid body and portions between the center and the peripheral portions formed as a resilient member, the center is fixed to said bearing device and the peripheral portions are fixed to a frame supporting said stator.

6. The X-ray tube apparatus as defined in claim 5 wherein said vibration damping means includes a cylindrical moving member fixed at the center of said support member and extending in the opposite direction to said bearing device and a fixed member disposed on said housing and encompassing the cylindrical outer circumference of said moving member with a predetermined gap between them, and said oil is fully charged in said gap.

7. The X-ray tube apparatus as defined in claim 6 wherein said fixed member is a part of said frame supporting said stator.

8. The X-ray tube apparatus as defined in claim 6 wherein said vibration damping means further includes a member placed inside said moving member with a predetermined gap between it and the inner circumference of said cylindrical moving member and having the end portion thereof fixed to said housing.

9. The X-ray tube apparatus as defined in any of claims 6 through 8 wherein said moving member is disposed in such a fashion that the end portion thereof facing the fixed end portion has a predetermined gap with respect to said housing.

10. The X-ray tube apparatus as defined in claim 6 wherein said support member, said frame and a part of said housing together form a sealed chamber, said moving member is placed inside said sealed chamber in such a fashion that the outer circumferential surface of said moving member faces the outer circumferential surface of said frame forming said sealed chamber with a predetermined gap between them, and a viscous liquid is sealed in the space inside said sealed chamber.

11. The apparatus of claim 10, wherein said gap is within the range of 0.3 to 0.6 mm. and said viscous liquid is oil substantially completely filling the space between said housing and said X-ray tube.

12. The apparatus of any one of claims 10 or 11, wherein said X-ray tube includes a hermetically sealed tube resiliently mounted within said housing and hermetically sealed to the fixed end of said bearing means with sufficient resiliency to permit vibration therebetween; and said support means resiliently supporting the adjacent end of said tube through said bearing means;

further including stator means fixedly mounted on said housing, spaced outwardly from said tube, and surrounding said rotor for transmitting magnetic energy to said rotor to rotate the same and form with said rotor an electric motor; and said gap being annular.

13. The apparatus of claim 12, wherein said fixed member and said movable member form a plurality of spaced apart annular gaps.

14. The apparatus of claim 10, wherein said maintaining means forms a sealed chamber enclosing said movable member and fixed member, with said viscous liquid completely filling said sealed chamber; said gap being greater than 0.3 mm.; and means providing insulating oil filling the space between said housing and generally enveloping said X-ray tube, with said insulating oil having a viscosity substantially less than said viscous liquid.

15. The apparatus of claim 14, wherein said support means non-rotatably mounts said bearing means and said movable member relative to said housing.

16. The apparatus of claim 15, wherein said spaced apart annular gaps are cylindrical and concentric with respect to each other.

17. The apparatus of claim 15, wherein one of said annular gaps is cylindrical and another of said annular gaps is entirely within a plane perpendicular to the axis of said cylindrical gap.

18. An X-ray tube apparatus, comprising:

a housing forming an accommodation chamber;

a rotary anode X-ray tube mounted within said accommodation chamber;

an electron beam generating cathode means fixedly mounted within said X-ray tube to generate an electron beam along a fixed path;

a rotor within said X-ray tube;

means hermetically sealng said X-ray tube and providing a vacuum therein;

bearing means providing a cantilevered mounting of said rotor for rotation about a fixed axis so that said rotor has a fixed end and a free end;

anode target means mounted on the free end of said rotor for rotation therewith in the path of said electron beam to generate X-rays;

support means providing the sole support between said housing and said bearing means, rotor and anode means with sufficient resiliency so that said bearing means, anode means and rotor will vibrate relative to said housing with relative movement relative to said housing being accommodated by said support means;

a movable member rigidly secured to said bearing means and resiliently mounted therewith by said support means to extend to the exterior of said X-ray tube;

a fixed member rigidly mounted on said housing closely adjacent said movement member at a substantial distance from said support means with a gap therebetween that will open and close with vibration of said rotor, anode means and bearing means; and means maintaining a viscous liquid within said gap for dampening said vibrations.

19. The apparatus of any one of claims 11, 14 or 18, wherein the cantilevered anode means, rotor and bearing means together with the support means has a spring constant within the range of 1–20 kg/mm. as measured by anode means displacement caused by a test load placed at the anode means.

* * * * *

UNITED STATES PATENT AND TRADEMARK OFFICE

CERTIFICATE OF CORRECTION

PATENT NO. : 4,433,432

DATED : February 21, 1984

INVENTOR(S) : Katsutoshi Nii et al

It is certified that error appears in the above-identified patent and that said Letters Patent is hereby corrected as shown below:

Please amend the Assignee information to read as follows:

-- Assignee: Hitachi, Ltd. and Hitachi Medical Corporation, both of Tokyo, Japan --

Signed and Sealed this

*Fifth* Day of *June 1984*

[SEAL]

*Attest:*

GERALD J. MOSSINGHOFF

*Attesting Officer*

*Commissioner of Patents and Trademarks*